US010156097B2

(12) United States Patent
Keshavan et al.

(10) Patent No.: US 10,156,097 B2
(45) Date of Patent: Dec. 18, 2018

(54) DOWNHOLE TOOL FOR INCREASING A WELLBORE DIAMETER

(71) Applicant: SMITH INTERNATIONAL, INC., Houston, TX (US)

(72) Inventors: Madapusi K. Keshavan, The Woodlands, TX (US); Praful C. Desai, Kingwood, TX (US); Iain M. Cooper, Sugar Land, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 818 days.

(21) Appl. No.: 14/298,592

(22) Filed: Jun. 6, 2014

(65) Prior Publication Data

US 2015/0068804 A1 Mar. 12, 2015

Related U.S. Application Data

(60) Provisional application No. 61/832,878, filed on Jun. 9, 2013.

(51) Int. Cl.

| | |
|---|---|
| ***E21B 10/32*** | (2006.01) |
| ***E21B 7/15*** | (2006.01) |
| ***E21B 7/124*** | (2006.01) |
| ***E21B 47/00*** | (2012.01) |

(52) U.S. Cl.

CPC ..... *E21B 10/32* (2013.01); *E21B 7/124* (2013.01); *E21B 7/15* (2013.01); *E21B 47/00* (2013.01)

(58) Field of Classification Search

USPC ..... 175/16, 263

See application file for complete search history.

(56) References Cited

U.S. PATENT DOCUMENTS

| | | | | |
|---|---|---|---|---|
| 3,285,349 | A | 11/1966 | Brandon | |
| 3,405,770 | A * | 10/1968 | Galle | E21B 7/18 175/56 |
| 4,227,582 | A | 10/1980 | Price | |
| 6,092,610 | A * | 7/2000 | Kosmala | E21B 4/20 175/27 |
| 2004/0206549 | A1 | 10/2004 | Dewey et al. | |
| 2004/0222022 | A1 | 11/2004 | Nevlud et al. | |

(Continued)

FOREIGN PATENT DOCUMENTS

| | | | | |
|---|---|---|---|---|
| RU | 2167991 C2 * | 5/2001 | | E21B 7/00 |

OTHER PUBLICATIONS

International Search Report and Written Opinion, dated Oct. 29, 2014 for PCT/US2014/041514; filed Jun. 9, 2014.

(Continued)

*Primary Examiner* — Cathleen R Hutchins
*Assistant Examiner* — Ronald R Runyan

(57) ABSTRACT

A downhole tool for increasing a diameter of a wellbore disposed within a subterranean formation. The downhole tool includes an underreamer having a plurality of cutter blocks moveably coupled thereto that move radially-outward from a refracted state to an expanded state. The cutter blocks cut the subterranean formation to increase the diameter of the wellbore from a first diameter to a second diameter when in the expanded state. A formation weakening tool may be coupled to the underreamer. The formation weakening tool weakens a portion of the subterranean formation positioned radially-outward therefrom.

17 Claims, 4 Drawing Sheets

(56) References Cited

U.S. PATENT DOCUMENTS

| | | | | |
|---|---|---|---|---|
| 2006/0102343 | A1 | 5/2006 | Skinner et al. | |
| 2009/0050371 | A1 | 2/2009 | Moeny | |
| 2009/0266609 | A1* | 10/2009 | Hall | E21B 47/00 175/45 |
| 2010/0089574 | A1* | 4/2010 | Wideman | E21B 7/14 166/272.1 |
| 2010/0089583 | A1 | 4/2010 | Wei et al. | |
| 2010/0212962 | A1* | 8/2010 | Rosten | E21B 7/15 175/40 |
| 2011/0220409 | A1 | 9/2011 | Foppe | |
| 2011/0247878 | A1* | 10/2011 | Rasheed | E21B 10/32 175/50 |
| 2012/0255774 | A1* | 10/2012 | Grubb | E21B 10/60 175/16 |

OTHER PUBLICATIONS

Communication pursuant to Article 94(3) EPC issued in related EP application 14810147.0 dated Aug. 23, 2016, 7 pages.
European Search Report issued in related EP application 14810147.0 dated Jul. 14, 2016, 4 pages.

* cited by examiner

DOWNHOLE TOOL FOR INCREASING A WELLBORE DIAMETER

CROSS-REFERENCE TO RELATED APPLICATION

The present application claims the benefit of U.S. Provisional Patent Application Ser. No. 61/832,878 filed Jun. 9, 2013, the entirety of which is incorporated herein by reference.

FIELD OF THE INVENTION

Embodiments described herein generally relate to a system and method for increasing a diameter of a wellbore. More particularly, embodiments described herein relate to weakening the walls of a wellbore prior to increasing the diameter of the wellbore with an underreamer.

BACKGROUND

A wellbore is drilled by a downhole tool having a drill bit coupled to a lower end portion thereof. The drill bit drills the wellbore to a first or "pilot hole" diameter. The downhole tool may include an underreamer coupled thereto and positioned above (e.g., 15 m-45 m above) the drill bit for increasing the diameter of the wellbore from the pilot hole diameter to a second diameter. The underreamer includes a body having one or more cutter blocks movably coupled thereto that transition from a retracted state to an expanded state. In the retracted state, the cutter blocks are folded into the body of the underreamer such that the cutter blocks are positioned radially-inward from the surrounding casing or wellbore wall. In the expanded state, the cutter blocks move radially-outward and into contact with the wellbore wall. The cutter blocks are then used to cut or grind the wall of the wellbore to increase the diameter thereof.

The underreamer may be in the expanded state as the drill bit drills the wellbore. As the underreamer is positioned above the drill bit, the portion of the formation surrounding the drill bit oftentimes has a different hardness than the portion of the formation surrounding the underreamer. For example, the portion of the formation surrounding the drill bit may be softer than the portion of the formation surrounding the underreamer. As a result, the drill bit has a greater rate of penetration "ROP" than the underreamer (i.e., the drill bit is able to drill faster than the underreamer is able to ream). This causes the underreamer to wear down as the drill bit "pulls" the underreamer through the harder portion of the formation at a rate that is faster than optimal. What is needed, therefore, is a system and method for weakening the walls of the wellbore prior to increasing the diameter of the wellbore with the underreamer.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool for increasing a diameter of a wellbore disposed within a subterranean formation is disclosed. The downhole tool includes an underreamer having a plurality of cutter blocks moveably coupled thereto that move radially-outward from a retracted state to an expanded state. The cutter blocks cut the subterranean formation to increase the diameter of the wellbore from a first diameter to a second diameter when in the expanded state. A formation weakening tool may be coupled to the underreamer. The formation weakening tool weakens a portion of the subterranean formation positioned radially-outward therefrom.

In another embodiment, the downhole tool may include a drill bit. A measurement while drilling tool may be coupled to the drill bit. A formation weakening tool may be coupled to the measurement while drilling tool. The formation weakening tool weakens a portion of the subterranean formation positioned radially-outward therefrom using vibrational energy, electro pulses, or a laser beam. An underreamer may be coupled to and positioned behind the formation weakening tool. The underreamer has a plurality of cutter blocks moveably coupled thereto that move radially-outward from a retracted state to an expanded state. The cutter blocks cut the weakened portion of the subterranean formation to increase the diameter of the wellbore from a first diameter to a second diameter when in the expanded state.

A method for increasing a diameter of a wellbore disposed within a subterranean formation is also disclosed. The method may include running a downhole tool into the wellbore. The downhole tool may include a drill bit, a formation weakening tool, and an underreamer. The formation weakening tool may be coupled to the drill bit. The underreamer may be coupled to and positioned behind the formation weakening tool. The underreamer has a plurality of cutter blocks moveably coupled thereto. The drill bit drills the wellbore in the subterranean formation to a first diameter. The formation weakening tool weakens a portion of the subterranean formation positioned radially-outward therefrom. The cutter blocks move radially-outward from a refracted position to an expanded position. The cutter blocks cut the weakened portion of the subterranean formation to increase the diameter of the wellbore from the first diameter to a second diameter.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
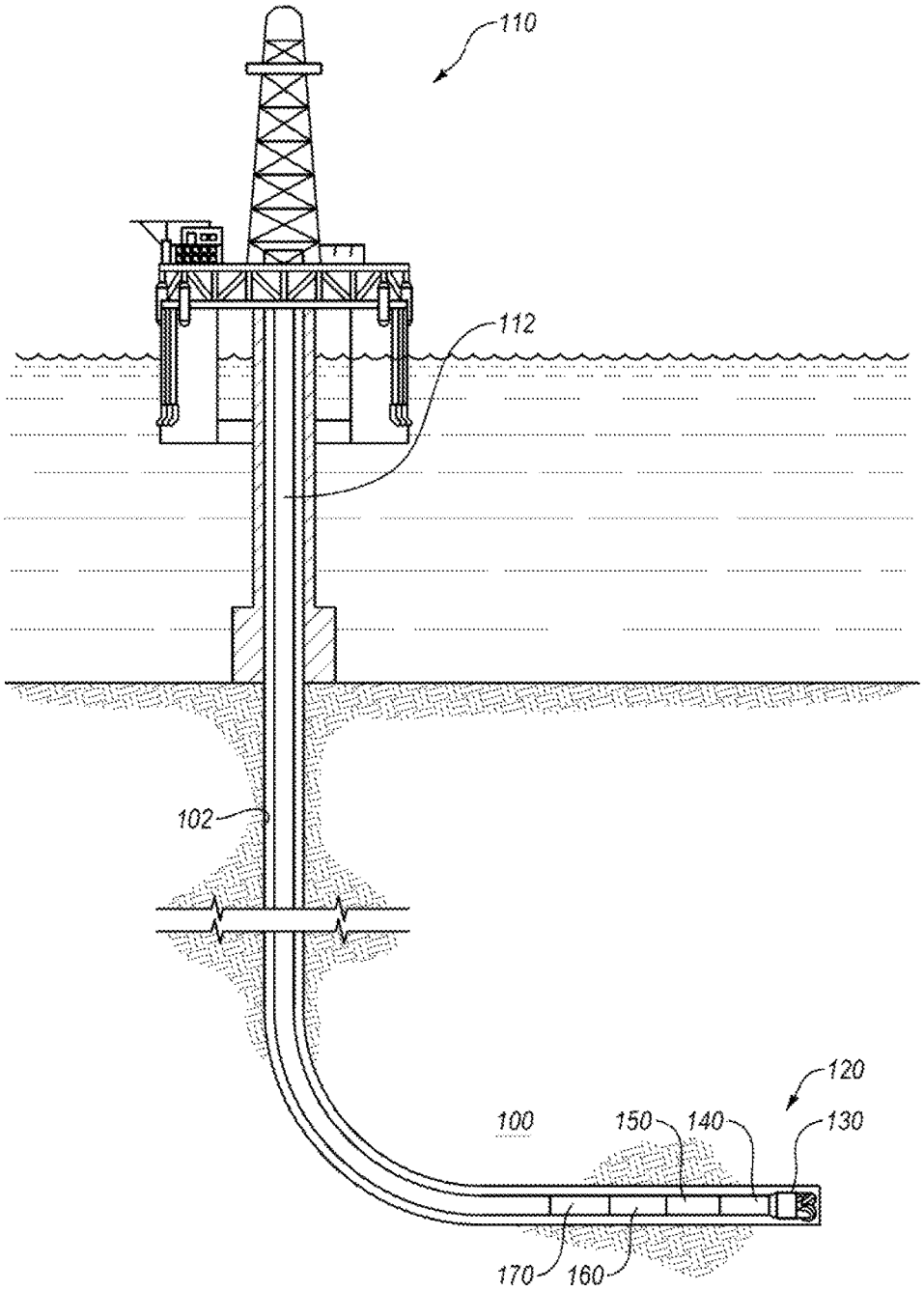
FIG. 1 depicts a schematic side view of an illustrative downhole tool disposed within a wellbore, according to one or more embodiments disclosed.

As generally shown in FIG. 1, a downhole tool 120 for increasing a diameter of a wellbore 102 disposed within a subterranean formation 100 is disclosed. The downhole tool 120 may include an underreamer 170 having a plurality of cutter blocks 310 (FIGS. 3 and 4) moveably coupled thereto that move radially-outward from a refracted state to an expanded state. The cutter blocks 310 are arranged and designed cut the subterranean formation 100 to increase the diameter of the wellbore 102 from a first diameter 104 to a second diameter 106 when in the expanded state. A formation weakening tool 160 may be coupled to the underreamer 170, the formation weakening tool 160 is arranged and designed to weaken a portion of the subterranean formation 100 positioned radially-outward therefrom.

Figure 2:
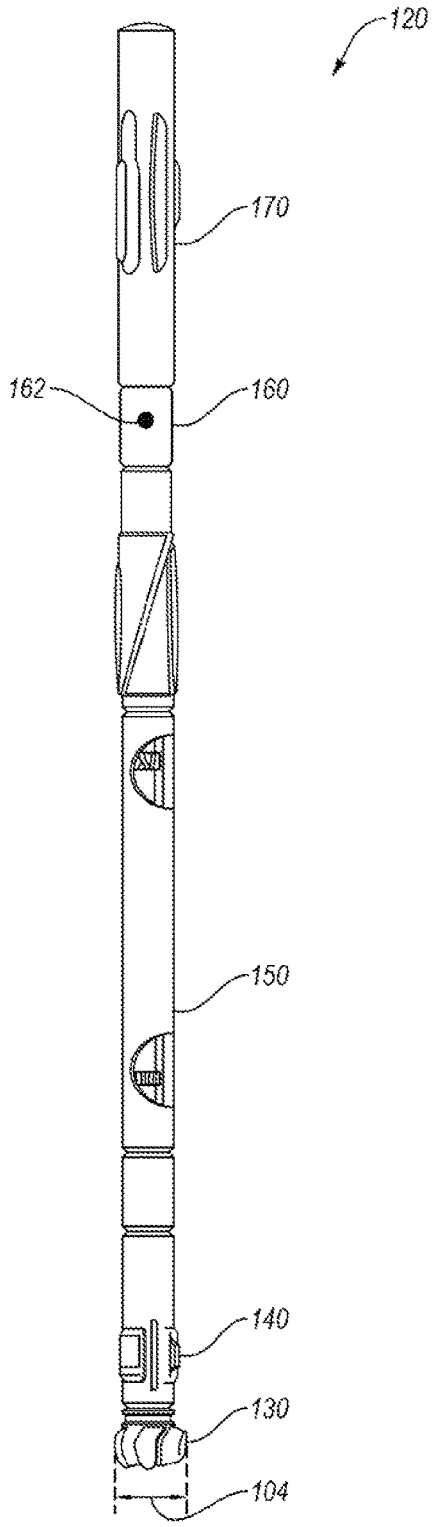
FIG. 2 depicts a schematic side view of the downhole tool shown in FIG. 1.

FIG. 1 depicts a schematic side view of an illustrative downhole tool 120 disposed within a wellbore 102, and FIG. 2 depicts a schematic side view of the downhole tool 120, according to one or more embodiments. The downhole tool 120 may be coupled to the end portion of a drill string 112. The drill string 112 and the downhole tool 120 may be at least partially disposed within a wellbore 102 formed in a subterranean formation 100. The drill string 112 and the downhole tool 120 may be raised and lowered within the wellbore 102 with a drilling rig 110.

The downhole tool 120 may include a drill bit 130, a rotary steerable tool ("RST") 140, a measurement while drilling ("MWD") tool 150, a formation weakening tool 160, and an underreamer 170. The drill bit 130 may be coupled to an end portion of the downhole tool 120. The drill bit 130 drills the wellbore 102 into the subterranean formation 100 at a first or "pilot hole" diameter 104 (see FIG. 2). The first diameter 104 may be from about 5 cm to about 50 cm. For example, the first diameter 104 may be from about 5 cm to about 10 cm, about 10 cm to about 15 cm, about 15 cm to about 20 cm, about 20 cm to about 30 cm, about 30 cm to about 40 cm, or about 40 cm to about 50 cm.

The rotary steerable tool 140 may be coupled to and positioned above the drill bit 130. The rotary steerable tool 140 may include a generally cylindrical body having an axial bore formed at least partially therethrough. The rotary steerable tool 140 is arranged and designed to turn or "steer" the downhole tool 120 as the drill bit 130 drills the wellbore 102. The rotary steerable tool 140 may be a "push the bit" tool or a "point the bit" tool.

A "push the bit" rotary steerable tool 140 may include one or more pads (not shown) disposed on an outer surface of the body. For example, a plurality of pads may be circumferentially and/or axially offset from one another on the outer surface of the body. The pads may be arranged and designed to individually and selectively move radially-outward to contact the subterranean formation 100 to "push the bit" in the desired direction. A "point the bit" rotary steerable tool 140 may include a shaft (not shown) disposed within the body. The shaft may be arranged and designed to bend within the body, which thereby causes the body to bend. The bending of the body may tilt or "point" the drill bit 130 in the desired direction.

The measurement while drilling tool 150 may be coupled to and positioned above the drill bit 130 and/or the rotary steerable tool 140. The measurement while drilling tool 150 may include a generally cylindrical body having an axial bore formed at least partially therethrough. The measurement while drilling tool 150 takes one or more measurements while the downhole tool 120 is positioned in the wellbore 102. The measurements may include, but are not limited to, direction (e.g., inclination and/or azimuth), pressure, temperature, vibration, axial and/or rotational speed, torque and/or weight on the drill bit 130, and the like. The measurements may be stored in the measurement while drilling tool 150 and/or transmitted to the surface using mud pulse telemetry, wired drill pipe, or electromagnetic frequency transmissions.

The formation weakening tool 160 may be coupled to and positioned above the drill bit 130, the rotary steerable tool 140, and/or the measurement while drilling tool 150. The formation weakening tool 160 is arranged and designed to weaken the portion of the subterranean formation 100 positioned radially-outward therefrom (e.g., the wall of the wellbore 102) ahead of the underreamer 170. More particularly, the formation weakening tool 160 is arranged and designed to spall or create small cracks in subterranean formation 100, to cause thermal degradation of the subterranean formation 100, and/or to weaken the chemical bonds between the grains in the subterranean formation 100. Weakening the subterranean formation 100 ahead of the underreamer 170 may make it easier for the underreamer 170 to increase the diameter of the wellbore 102, as discussed in more detail below with reference to FIGS. 3 and 4.

The formation weakening tool 160 may weaken the subterranean formation 100 by oscillating or vibrating and transmitting this dynamic vibrational energy into the subterranean formation 100 through physical contact with the wall of the wellbore 102. The vibrational energy may be generated by the rotary motion of the drill string 112 and/or moving a first plurality of magnets with respect to a second plurality of magnets. For example, the first plurality of magnets may be disposed radially-inward from and concentric with the second plurality of magnets, and the first plurality of magnets may move or rotate with respect to the second plurality of magnets. The vibrational energy may also be generated by a piezoelectric device.

The frequency of the vibrational energy may be from about 1 Hz to about 1 kHz or more. For example, the frequency may be from about 1 Hz to about 10 Hz, about 10 Hz to about 50 Hz, about 50 Hz to about 100 Hz, about 100 Hz to about 250 Hz, or about 250 Hz to about 1 kHz. The resonance may occur when the frequency of the vibrational energy is substantially equal to the natural frequency of the rotating drill string 112. The frequency and/or amplitude of the vibrational energy may be selectively varied to control the amount that the subterranean formation 100 is weakened.

In another embodiment, the formation weakening tool 160 may weaken the subterranean formation 100 by generating electro pulses or electromagnetic pulses and transmitting the pulses radially-outward toward the wall of the wellbore 102. The electro pulses may be discharged into the subterranean formation 100 by one or more electrodes disposed on an exterior of the formation weakening tool 160. The electrical energy may be provided by an electrical power supply disposed within the downhole tool 120 and/or at the surface. For example, the electrical energy may be generated by pumping or flowing drilling fluid through a turbine disposed within the downhole tool 120 (e.g., the measurement while drilling tool 150). As the electro pulses are discharged, the subterranean formation 100 proximate the electrodes may fracture and weaken. The frequency and/or amplitude of the electro pulses may be selectively varied to control the amount that the subterranean formation 100 is weakened.

In yet another embodiment, the formation weakening tool 160 may include one or more lasers 162. The lasers 162 may be circumferentially and/or axially offset from one another on the formation weakening tool 160. The lasers 162 may emit a beam of light or energy radially-outward toward the wall of the wellbore 102. The profile of the beam, the specific power of the beam, the exposure time of the beam, and/or the distance from the subterranean formation 100 may be selectively controlled and depend on the properties of the subterranean formation 100. The delivery of the beam may be carried out by fiber optic cable to the desired depth. The power of the beam may range from about 100 W to about 25 kW or more. For example, the power of the beam may be from about 100 W to about 1 kW, about 1 kW to about 5 kW, about 5 kW to about 10 kW, or about 10 kW to about 25 kW. The amount and/or intensity of the light or energy emitted from the laser 162 may be selectively varied to control the amount that the subterranean formation 100 is weakened.

The underreamer 170 may be coupled to and positioned above (i.e., behind) the formation weakening tool 160. The underreamer 170 is arranged and designed to actuate from a retracted state to an expanded state, as described in more detail below with reference to FIGS. 3 and 4.

Figure 3:
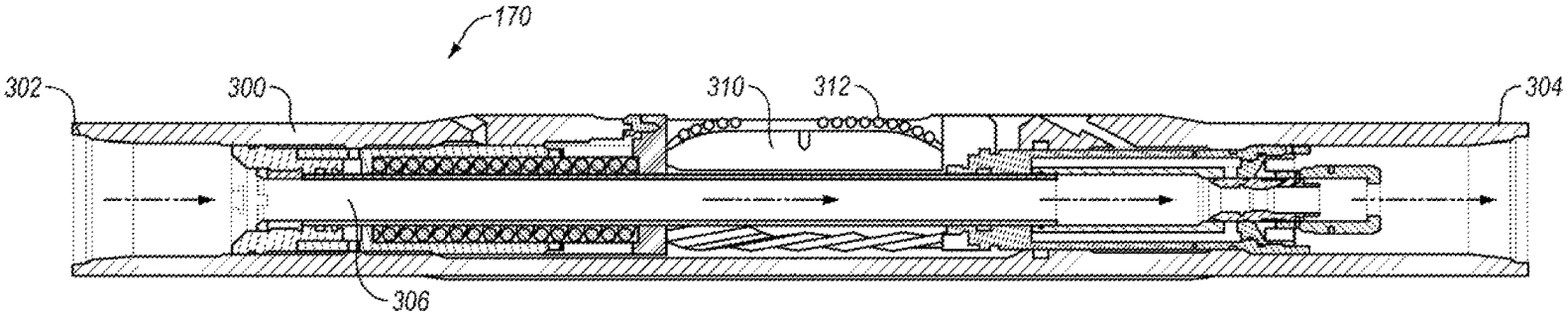
FIG. 3 depicts a cross-section view of an illustrative underreamer in a retracted state, according to one or more embodiments disclosed.
Figure 4:
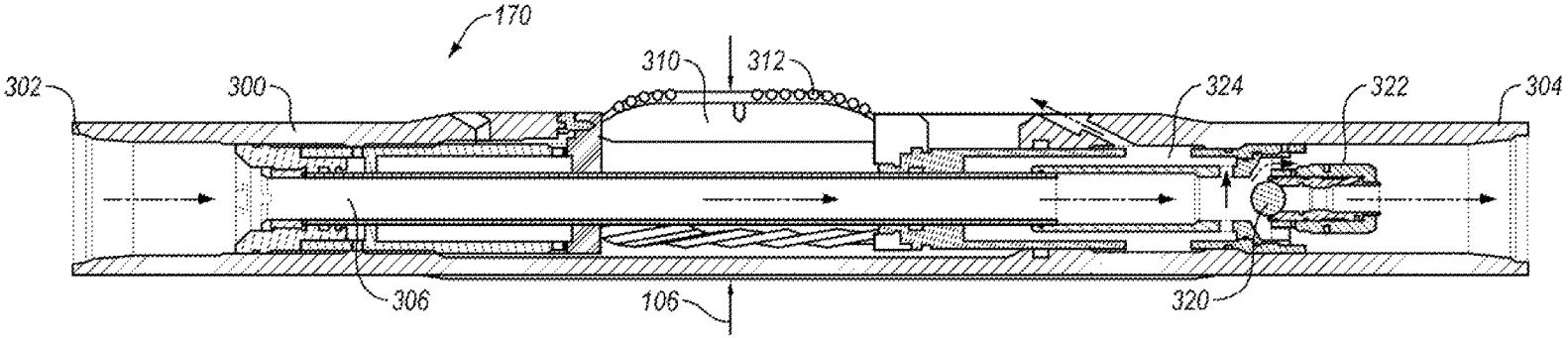
FIG. 4 depicts a cross-section view of an illustrative underreamer in an expanded state, according to one or more embodiments disclosed.

FIG. 3 depicts a cross-section view of the underreamer 170 in the retracted state, and FIG. 4 depicts a cross-section view of the underreamer 170 in the expanded state, according to one or more embodiments. The underreamer 170 includes a body 300 having a first end portion 302, a second end portion 304, and an axial bore 306 formed at least partially therethrough. One or more cutter blocks 310 may be moveably coupled to the body 300. The number of cutter blocks 310 may range from a low of 1, 2, 3, or 4 to a high of 6, 8, 10, 12, or more. The cutter blocks 310 may be axially and/or circumferentially offset from one another. For example, the underreamer 170 may include three cutter blocks 310 that are circumferentially offset from one another.

The cutter blocks 310 may each have a plurality of cutting contacts or inserts 312 disposed on an outer radial surface thereof. In at least one embodiment, the cutting inserts 312 may include polycrystalline diamond cutters ("PDCs") or the like. The cutting inserts 312 cut, grind, or scrape the wall of the wellbore 102 to increase the diameter thereof when the underreamer 170 is in the expanded state.

The cutter blocks 310 may also have a plurality of stabilizing pads or inserts (not shown) disposed on the outer radial surfaces thereof. The stabilizing inserts may be or include tungsten carbide inserts, or the like. The stabilizing inserts absorb and reduce vibration between the cutter blocks 310 and the wall of the wellbore 102.

As shown in FIG. 3, when the underreamer 170 is in the retracted state, the cutter blocks 310 are folded into or retracted into corresponding apertures or cavities in the body 300 such that the outer surfaces of the cutter blocks 310 are aligned with, or positioned radially-inward from, the outer surface of the body 300. As such, the underreamer 170 may be raised or lowered in the wellbore 102 without the cutter blocks 310 contacting the wall of the wellbore 102.

As shown in FIG. 4, the underreamer 170 may be actuated into the expanded state, for example, by introducing an impediment (e.g., a ball) 320 into the bore 306. For example, the ball 320 may flow through the bore 306 and become seated on an internal piston 322 in the body 300, thereby obstructing the flow through the bore 306. This causes a pressure drop which may push the piston 322 toward the second end portion 304 of the body 300, thereby allowing a portion of the fluid to flow into a chamber 324 that was initially closed/obstructed by the piston 322. The pressurized fluid in the chamber 324 exerts a force on the cutter blocks 310 in a direction toward the first end portion 302 of the body 300. This force may cause the cutter blocks 310 to simultaneously move axially toward the first end portion 302 of the body 300 and radially-outward until the underreamer 170 is in the expanded state. However, as may be appreciated, the ball-drop actuation is merely one illustrative technique to actuate the underreamer 170 into the expanded state, and other techniques are also contemplated herein.

When the underreamer 170 is in the expanded state, the cutter blocks 310 are fully or sufficiently expanded cut or grind the wall of the wellbore 102, thereby increasing the diameter of the wellbore 102 from the first diameter 104 to a second diameter 106 (FIG. 4). The second diameter 106 may be from about 10 cm to about 100 cm. For example, the second diameter 106 may be from about 10 cm to about 15 cm, about 15 cm to about 20 cm, about 20 cm to about 30 cm, about 30 cm to about 50 cm, about 50 cm to about 75 cm, or about 75 cm to about 100 cm. As such, the second diameter 106 may be greater than the first diameter 104 by about 20% to about 25%, about 25% to about 30%, about 30% to about 35%, about 35% to about 40%, about 40% to about 50%, about 50% to about 60%, about 60% to about 70%, about 70% to about 80%, about 20% to about 80%, or about 40% to about 80%.

Figures 5, 6, 7, 8:
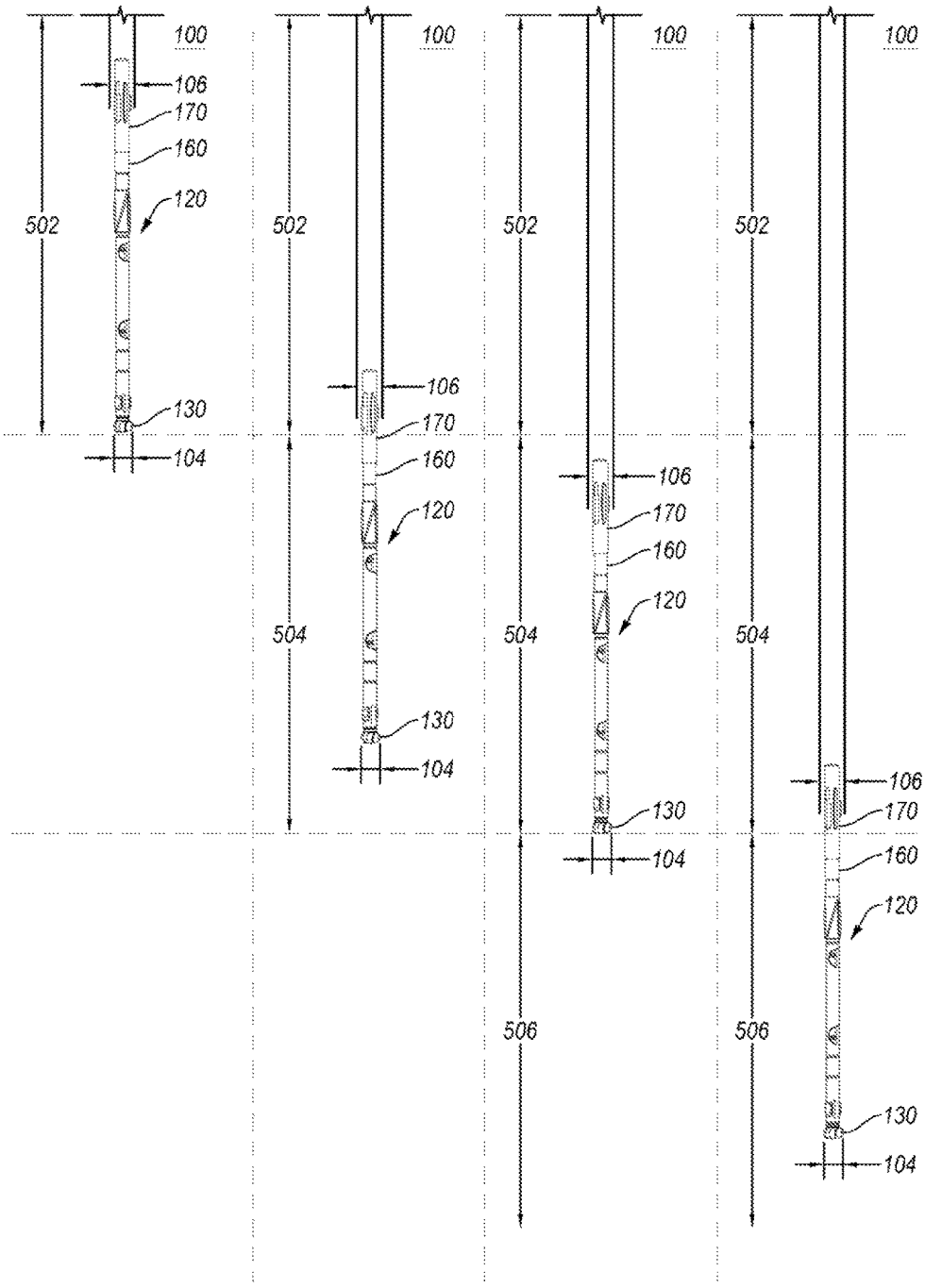
FIG. 5 depicts the downhole tool disposed within a first layer of the formation, according to one or more embodiments disclosed.
FIG. 6 depicts the drill bit disposed within a second layer of the formation and the underreamer disposed within the first layer of the formation and approaching the second layer of the formation, according to one or more embodiments disclosed.
FIG. 7 depicts the downhole tool disposed within the second layer of the formation and the drill bit approaching a third layer of the formation, according to one or more embodiments disclosed.
FIG. 8 depicts the drill bit disposed within the third layer of the formation and the underreamer disposed within the second layer of the formation and approaching the third layer of the formation, according to one or more embodiments disclosed.

FIGS. 5-8 depict the operation of the downhole tool 120 drilling and reaming the wellbore 102 through layers 502, 504, 506 of the formation having different hardness. More particularly, FIG. 5 depicts the downhole tool 120 disposed within a first layer 502 of the subterranean formation 100, according to one or more embodiments. The first layer 502 may be a relatively "soft" layer in the subterranean formation 100. For example, the first layer 502 may be or include unconsolidated sand, clay, limestone, red beds, and/or shale and have a compressive stress ranging from about 700 kPa (102 PSI) to about 70 MPa (10,200 PSI).

The drill bit 130 may drill through the first layer 502 to form the wellbore 102 having the first diameter 104. The underreamer 170 may be in the expanded state as the drill bit 130 drills the wellbore 102. Accordingly, the underreamer 170 may expand the diameter of the wellbore 102 from the first diameter 104 to the second diameter 106 as the downhole tool 120 progresses through the subterranean formation 100. The underreamer 170 may be positioned about 15 m to about 45 m above (i.e., behind) the drill bit 130. As a result, the portion of the wellbore 102 between the drill bit 130 and the underreamer 170 may be at the first diameter 104, while the portion of the wellbore 102 above the underreamer 170 may be at the second diameter 106.

FIG. 6 depicts the drill bit 130 disposed within a second layer 504 of the subterranean formation 100 and the underreamer 170 disposed within the first layer 502 of the subterranean formation 100 and approaching the second layer 504 of the subterranean formation 100, according to one or more embodiments. The second layer 504 may be a relatively "hard" layer in the subterranean formation 100. More particularly, the second layer 504 may have a greater compressive stress than the first layer 502. For example, the second layer 504 may be or include calcites, dolomites, hard shale, mudstones, cherty lime stone, and/or iron ore and have a compressive stress ranging from about 70 MPa (10,200 PSI) to about 240 MPa (34,800 PSI) or more.

The rate of penetration ("ROP") of the downhole tool 120 through the subterranean formation 100 may decrease as the drill bit 130 enters the second layer 504. As the underreamer 170 approaches the second layer 504, the formation weakening tool 160 may be actuated into an active state such that the formation weakening tool 160 weakens the portion of the subterranean formation 100 positioned radially-outward therefrom (i.e., the walls of the wellbore 102). For example, the formation weakening tool 160 may transmit vibrational energy, electro pulses, or beams of laser radially-outward into the subterranean formation 100. Weakening the portion of the subterranean formation 100 ahead of the underreamer 170 may make it easier for the underreamer 170 to increase the diameter of the wellbore 102 to the second diameter 106. In addition to actuation of the formation weakening tool 160 into the active state, the weight on the drill bit 130 ("WOB") may be reduced to reduce the weight or force on the underreamer 170.

FIG. 7 depicts the downhole tool 120 disposed within the second layer 504 of the subterranean formation 100 and the drill bit 130 approaching a third layer 506 of the subterranean formation 100, according to one or more embodiments. The third layer 506 may be a relatively "soft" layer in the subterranean formation 100. More particularly, the third layer 506 may have a lower compressive stress than the second layer 504. The rate of penetration of the downhole tool 120 may remain substantially the same as the drill bit 130 enters the third layer 506. This may be achieved by maintaining or reducing the weight on the drill bit 130 and or the revolutions per minute ("RPM") of the drill bit 130 as the drill bit 130 enters the third layer 506.

FIG. 8 depicts the drill bit 130 disposed within the third layer 506 of the subterranean formation 100 and the underreamer 170 disposed within the second layer 504 of the subterranean formation 100 and approaching the third layer 506 of the subterranean formation 100, according to one or more embodiments. The rate of penetration of the downhole tool 120 may remain substantially the same or increase as the underreamer 170 enters the third layer 506. The formation weakening tool 160 may remain in the active state when the underreamer 170 is in the third layer 506, or the formation weakening tool 160 may be actuated into an inactive state. In at least one embodiment, the formation weakening tool 160 may be in the active state when the underreamer 170 is in the expanded state. For example, the formation weakening tool 160 may be in the active state through the first, second, and third layers 502, 504, 506.

In at least one embodiment, the measurement while drilling tool 150 may measure the hardness of the subterranean formation 100 and transmit this information to a computer system or operator positioned at the surface. In another embodiment, the measurement while drilling tool 150 may measure the rate of penetration of the drill bit 130 and/or the underreamer 170 through the subterranean formation 100 to determine when the downhole tool 120 enters a layer (e.g., layer 504) having a different hardness and transmit this information to the surface. In yet another embodiment, the measurement while drilling tool 150 may measure the weight on the drill bit 130 and/or the underreamer 170 and transmit this information to the surface. In yet another embodiment, the measurement while drilling tool 150 may measure the weakening of the subterranean formation 100 caused by the formation weakening tool 160 and transmit this information to the surface.

The information transmitted to the surface may allow the computer system or operator to maintain or vary one or more parameters including the weight on the drill bit 130 and/or the underreamer 170, the rate of penetration of the drill bit 130 and/or the underreamer 170, and/or whether the formation weakening tool 160 is in the active state or the inactive state. The parameters may be varied so that the rate of penetration of the drill bit 130 is substantially the same as the rate of penetration of the underreamer 170, even when the drill bit 130 and the underreamer 170 are disposed within layers (e.g., 504, 506) having different hardness.

As used herein, the terms "inner" and "outer;" "up" and "down;" "upper" and "lower;" "upward" and "downward;" "above" and "below;" "inward" and "outward;" and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although only a few example embodiments have been described in detail above, those skilled in the art will readily appreciate that many modifications are possible in the example embodiments without materially departing from "Downhole Tool for Increasing a Wellbore Diameter." Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 120, paragraph 6 for any limitations of any of the claims herein, except for those in which the claim expressly uses the words 'means for' together with an associated function.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. A downhole tool for increasing a diameter of a wellbore disposed within a subterranean formation, comprising:

an underreamer having a plurality of cutter blocks moveably coupled thereto that move radially-outward from a retracted state to an expanded state, the cutter blocks being arranged and designed to cut the subterranean formation to increase the diameter of the wellbore from a first diameter to a second diameter when in the expanded state;

a formation weakening tool coupled to the underreamer and axially displaced from the underreamer, the formation weakening tool configured to weaken a portion of the subterranean formation positioned radially-outward therefrom, the formation weakening tool being selectively actuatable between active and inactive states, and the formation weakening tool being positioned ahead of the underreamer while the formation weakening tool is in the active and inactive states and configured to, while in the active state, weaken the portion of the subterranean formation before the underreamer cuts the portion of the subterranean formation to increase the diameter of the wellbore from the first diameter to the second diameter, the formation weakening tool including a plurality of lasers that are axially offset from one another; and a measurement while drilling tool coupled to the formation weakening tool, the measurement while drilling tool arranged and designed to activate the formation weakening tool based upon a hardness of the subterranean formation.

2. The downhole tool of claim 1, wherein the formation weakening tool is arranged and designed to selectively vary at least one of a beam profile, an exposure time, or a distance from the subterranean formation of radially-outward directed energy used to weaken the portion of the subterranean formation, the selective variation being based on properties of the subterranean formation.

3. The downhole tool of claim 1, wherein the formation weakening tool transmits vibrational energy radially-outward to weaken the portion of the subterranean formation.

4. The downhole tool of claim 1, wherein the formation weakening tool transmits electro pulses radially-outward to weaken the portion of the subterranean formation.

5. The downhole tool of claim 1, wherein at least one of the plurality of lasers is arranged and designed to emit a laser beam radially-outward to weaken the portion of the subterranean formation.

6. The downhole tool of claim 1, wherein the second diameter is about 40% to about 80% greater than the first diameter.

7. The downhole tool of claim 1, the measurement while drilling tool being arranged and designed to measure a parameter and to transmit the measured parameter to an operator or computer system at the surface.

8. The downhole tool of claim 7, further comprising a drill bit coupled to the measurement while drilling tool, wherein the parameter is selected from the group consisting of a rate of penetration of the underreamer, a weight on the underreamer, and a rate of weakening the subterranean formation.

9. The downhole tool of claim 1, wherein the formation weakening tool weakens the subterranean formation by spalling a wall of the wellbore.

10. The downhole tool of claim 1, wherein the measurement while drilling tool is arranged and designed to transmit a measured parameter to an operator or computer system at the surface.

11. A downhole tool for increasing a diameter of a wellbore disposed within a subterranean formation, comprising:

a drill bit;

a formation weakening tool arranged and designed to weaken a portion of the subterranean formation positioned radially-outward therefrom, the formation weakening tool including a plurality of lasers that are axially offset from one another;

an underreamer coupled to and positioned behind the formation weakening tool, the underreamer having a plurality of cutter blocks moveably coupled thereto that move radially-outward from a retracted state to an expanded state, the cutter blocks being arranged and designed cut the weakened portion of the subterranean formation to increase the diameter of the wellbore from a first diameter to a second diameter when in the expanded state; and a measurement while drilling tool coupled to the drill bit and to the formation weakening tool, the measurement while drilling tool arranged and designed to measure and transmit a parameter selected from the group consisting of a rate of penetration of the underreamer, a weight on the underreamer, and a rate of weakening the subterranean formation, wherein the measurement while drilling tool is further arranged and designed to measure a hardness of the subterranean formation.

12. The downhole tool of claim 11, wherein the second diameter is about 40% to about 80% greater than the first diameter.

13. The downhole tool of claim 11, wherein the formation weakening tool weakens the subterranean formation by spalling a wall of the wellbore.

14. A method for increasing a diameter of a wellbore disposed within a subterranean formation, comprising:

running a downhole tool into the wellbore, the downhole tool including:

a drill bit;

a formation weakening tool coupled to the drill bit, the formation weakening tool including a plurality of lasers that are axially offset from one another; and an underreamer coupled to and positioned behind the formation weakening tool, the underreamer having a plurality of cutter blocks moveably coupled thereto;

drilling the wellbore in the subterranean formation with the drill bit to a first diameter;

selectively actuating the formation weakening tool based on at least a hardness of the subterranean formation weakening a portion of the subterranean formation with the formation weakening tool, the weakened portion of the subterranean formation being positioned radially-outward from the formation weakening tool and downhole of the underreamer;

moving the plurality of cutter blocks radially-outward from a retracted position to an expanded position;

cutting the weakened portion of the subterranean formation with the plurality of cutter blocks to increase the diameter of the wellbore from the first diameter to a second diameter; and monitoring a rate of penetration of the underreamer in the subterranean formation.

15. The method of claim 14, further comprising:

monitoring a rate of penetration of the drill bit in the subterranean formation; and comparing the rate of penetration of the underreamer to the rate of penetration of the drill bit.

16. The method of claim 14, wherein weakening the portion of the subterranean formation comprises transmitting vibrational energy into a wall of the wellbore.

17. The method of claim 14, wherein weakening the portion of the subterranean formation comprises transmitting electro pulses into a wall of the wellbore.

* * * * *